United States Patent [19]

Smith et al.

[11] 4,265,071

[45] May 5, 1981

[54] APPARATUS AND METHOD FOR REMOVING CLOSURES FROM CONTAINERS ASSEMBLED IN CASES

[75] Inventors: James D. Smith, Freeport; James A. Miller, Apollo, both of Pa.

[73] Assignee: Aluminum Company of America, Pittsburgh, Pa.

[21] Appl. No.: 75,150

[22] Filed: Sep. 12, 1979

Related U.S. Application Data

[63] Continuation of Ser. No. 864,776, Dec. 27, 1977, abandoned.

[51] Int. Cl.[3] ..... B65B 43/40

[52] U.S. Cl. ..... 53/492; 53/331.5; 81/3.32

[58] Field of Search ..... 53/396, 492, 76, 331.5, 53/381 A; 81/3.2, 3.32

[56] References Cited

U.S. PATENT DOCUMENTS

| | | | |
|---|---|---|---|
| 2,130,317 | 9/1938 | Clarke | 53/381 A |
| 3,520,102 | 7/1970 | Henrion | 53/381 A |
| 3,587,208 | 6/1971 | Berry | 53/381 A |
| 3,589,103 | 6/1971 | Calvillo | 53/381 A |
| 3,686,824 | 8/1972 | Rink | 53/381 A |
| 3,775,829 | 12/1973 | Rice | 53/381 A |
| 3,803,795 | 4/1974 | Ouellette | 53/76 |
| 3,805,490 | 4/1974 | Blecher | 53/381 A |
| 3,807,134 | 4/1974 | Zalkin | 53/381 A |
| 3,812,742 | 5/1974 | Polasek | 81/3.32 |
| 3,845,605 | 11/1974 | Hartness | 53/492 |
| 3,852,867 | 12/1974 | Risener . | |
| 3,906,706 | 9/1975 | Conti | 53/331.5 |
| 4,172,397 | 10/1979 | Herbert | 53/381 A |

FOREIGN PATENT DOCUMENTS

| | | | |
|---|---|---|---|
| 601622 | 5/1948 | United Kingdom | 53/381 A |
| 746156 | 3/1956 | United Kingdom | 53/331 J |

*Primary Examiner*—John Sipos

*Attorney, Agent, or Firm*—Patrick J. Viccaro

[57] ABSTRACT

A method and apparatus are provided for removing closures from containers that are assembled in cases which are moved seriatum into position below multiple spindles arranged with respect to the container positions in the case. Each spindle has a non-rotatable internally threaded nut with a freely rotatable externally threaded screw therethrough, and a head unit for gripping a closure on the container. Axial displacement of the multiple spindles with respect to the containers causes the head unit of each spindle to grip a container only by its closure, if it has one thereon. Axial displacement of the screw with respect to the nut rotates the screw with sufficient torque to break any bond or seal securing the closure without need of holding the container to prevent its rotation.

12 Claims, 13 Drawing Figures

FIG. 3.
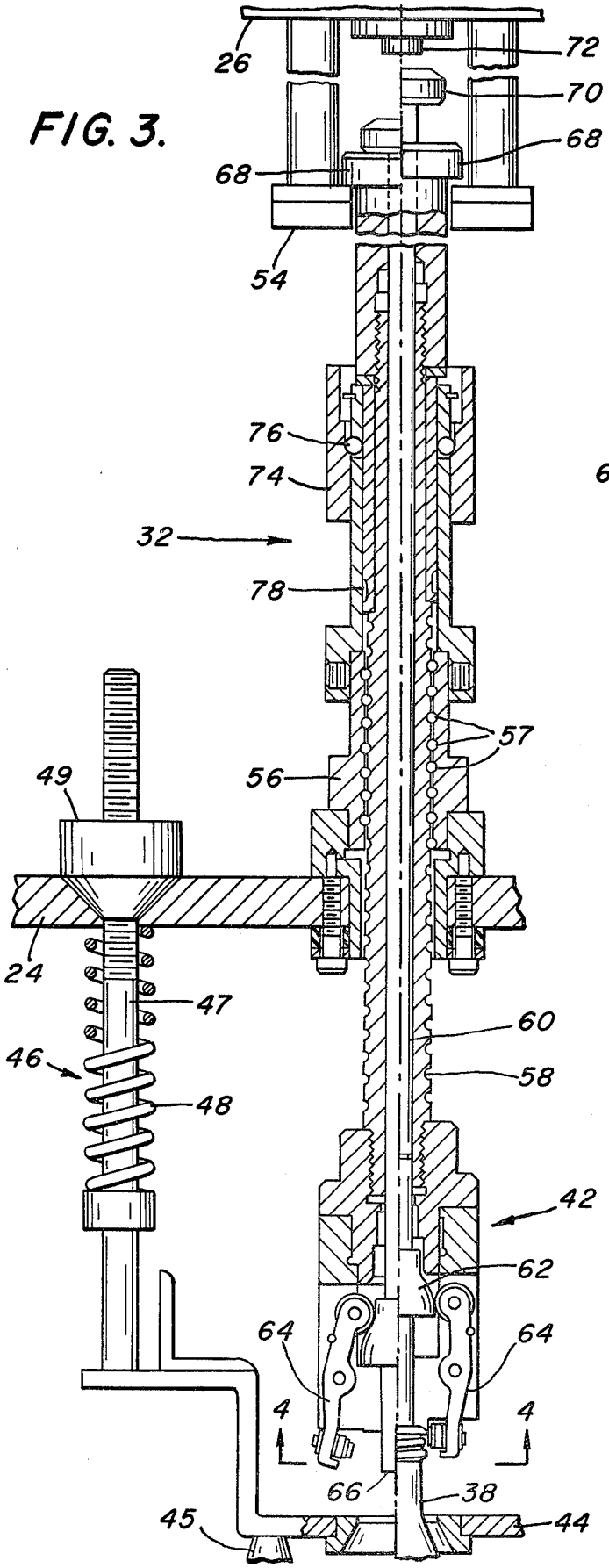
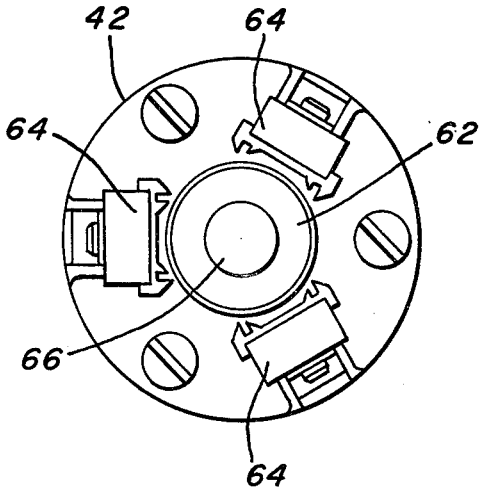
FIG. 4.

FIG. 6.
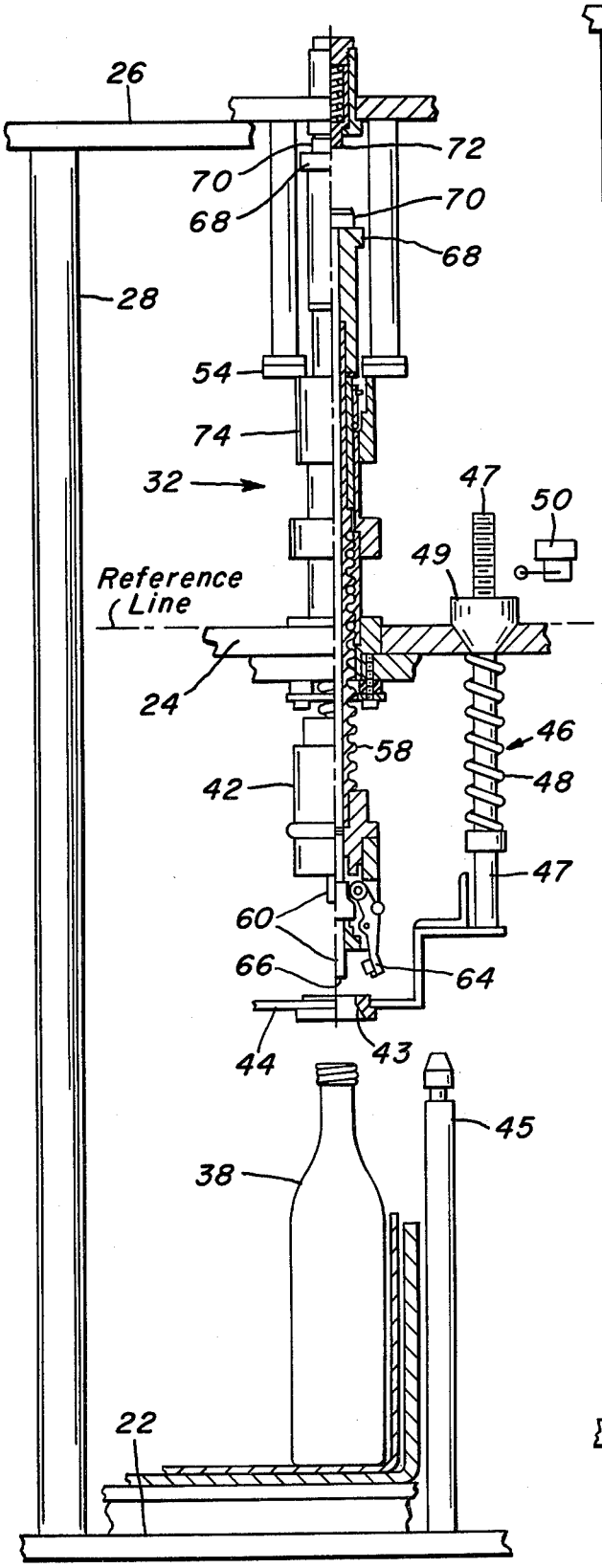
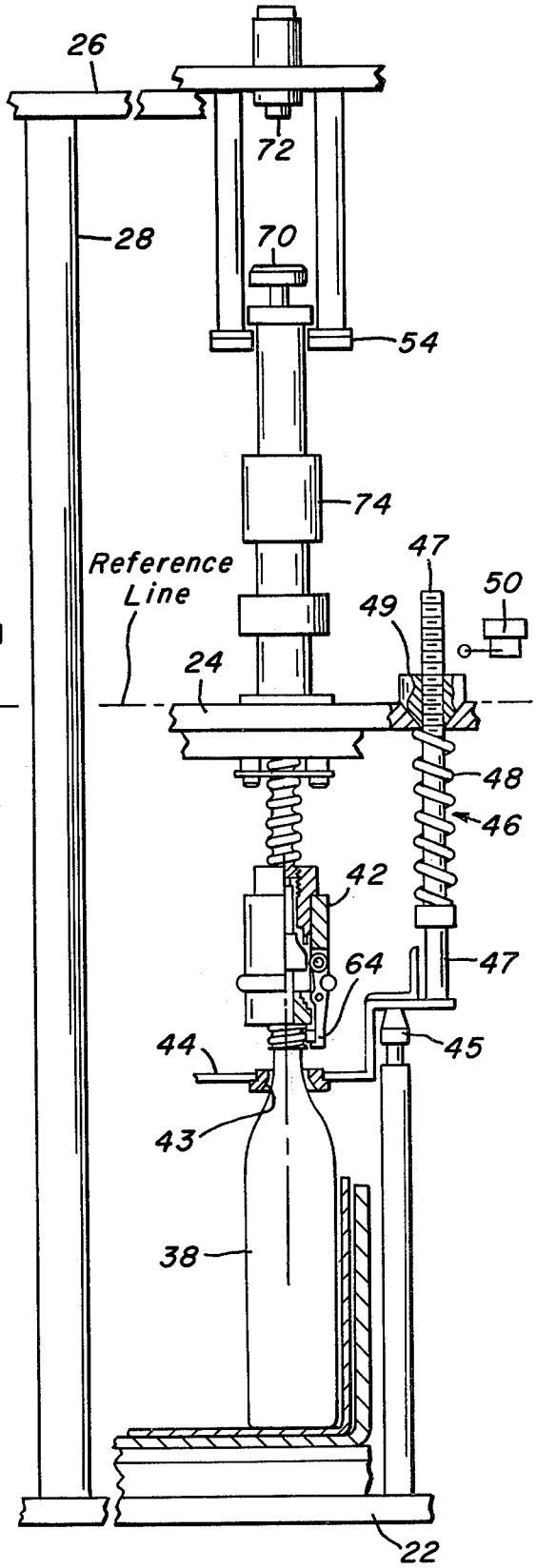
FIG. 7.

APPARATUS AND METHOD FOR REMOVING CLOSURES FROM CONTAINERS ASSEMBLED IN CASES

This is a continuation of Application Ser. No. 864,776 filed Dec. 27, 1977, now abandoned.

BACKGROUND OF THE INVENTION

This invention relates to the removal of screw-off closures from containers. More particularly, this invention relates to the removal of screw-off closures from containers assembled in cases which are moved seriatum into and out of position.

There has been increased concern for the container industry to encourage recycling of containers. For containers, such as beverage bottles having screw-off or twist-off closures, the consumer has been urged to return the metallic caps or closures associated with the bottles by replacing the caps on the bottles. The bottles are returned in cases to the bottling plant, but before the bottles can be cleaned and prepared for refilling, it is necessary to remove any metallic caps from the returned bottles. A problem of removing such closures efficiently is enhanced by the fact that millions of bottles are returned for recycling annually. Thus, a quick and easy removal of such closures is desired to reduce the bottle reclamation costs for the bottling industry.

In the prior art, there have been various ways proposed to remove the closures from containers as they pass singly along the bottling lines. One such way includes the use of an Archimedean screw passing through an internally threaded bush or nut and a jaw means on the end of the screw for gripping closures. Such a device is operated by fluid pressure and includes the use of hold-down pads to secure the container against rotation during the unscrewing operation, i.e. when the screw moves in the nut to cause rotation of the jaws to remove screw-off closures, as shown in U.S. Pat. No. 2,130,317, granted Sept. 13, 1938. Various other methods have also been tried which pierce or puncture the container closure to facilitate closure removal. Piercing of the metallic cap by a needle and forcing compressed air into the container to facilitate removal of the closure is shown in U.S. Pat. No. 3,587,208, granted June 28, 1971. Insertion of a blade into the closure and rotation thereof to remove a closure is shown in U.S. Pat. Nos. 3,520,102, granted July 14, 1970 and 3,775,829, granted Dec. 4, 1973. Screw-off caps can also be removed by the use of rotating impact rollers which contact the outside surface of the closure, as shown in U.S. Pat. No. 3,807,134, granted Apr. 30, 1974 and by the use of an endless moving belt, as shown in U.S. Pat. No. 3,845,605, granted Nov. 5, 1974.

In order to more efficiently remove screw-off closures from the millions of returned containers, it is known in the art to remove the closures while maintaining the containers in their cases. Such in-case decapping of containers obviates the need to remove each container from a case and to place it onto a bottling line to remove the closures from the containers singly. Such prior art in-case decapping methods and apparatus include moving a case of containers into position beneath a decapping apparatus having multiple head units which move vertically down onto containers in a case to facilitate removal of closures from all containers simultaneously. Such mechanisms include sensing devices for counting bottles and checking bottles to see if they are free of closures and for determining alignment or misalignment of bottles, and ejecting means for disposing of the closures from the head units and means for collecting such removed closures. Such mechanisms, however, may also include a large and/or complex gearing arrangement to facilitate vertical movement and rotation of the multiple head units. Repairs or replacement of a single head unit in the mechanism may, thus, be difficult. Additionally, the decapping apparatus may not be easily adjustable to accommodate various size closures and cases containing various numbers of containers per case.

Removal of closures from containers while in their cases has been proposed in various ways including piercing a closure with two pins and causing rotation of the closure while securing the container against rotation with a holding sleeve, as shown in U.S. Pat. No. 3,589,103, granted June 29, 1971. Still another device uses two continuous moving belts positioned on opposite sides of the closures of the containers to cause removal of the closures, see U.S. Pat. No. 3,852,867, granted Dec. 10, 1974. A fluid pressure gripping device of U.S. Pat. No. 3,686,824, granted Aug. 29, 1972 grips the closures of each container with a piercing pin and a holding sleeve having an inflatable element. Rotation of the device removes the closure and a subsequent reduction of pressure deflates the holding sleeve to eject the removed closure from the gripping device. U.S. Pat. No. 3,803,795, granted Apr. 16, 1974 shows the removal of closures from containers without the need of holding the containers by the use of a continuously rotating cup-shaped device which fits over the closure of a container and causes removal of the closure by engaging with the serrations of the closure.

There still exists a need, however, for an apparatus and method of removing twist-off closures from containers being transported in cases along a return case conveyor system in a bottling plant that is low in cost and can easily and inexpensively be installed on an existing return case conveyor in a bottling plant bottle return area. Such a device should have components that can be changed to accommodate various size closures and cases containing various numbers of bottles per case. Contact with the container, especially at the neck area, should be limited or avoided to prevent marring of the container finish and excessive wearing of any advertising on the container. Yet sufficient unscrewing torque must be provided to break any temporary bond or seal securing a closure to a container. It is also desirable to incorporate safety features to prevent damage to the apparatus due to improperly located containers or damaged cases.

SUMMARY OF THE INVENTION

In accordance with the present invention, closures are quickly removed from containers being transported in cases without damage to carrying handles of container cartons and without damage to misaligned or improperly located bottles. Generally stated, the invention contemplates the removal of screw-off closures by an apparatus having multiple spindles arranged with respect to container positions in a case and a non-rotatable internally threaded nut associated with each spindle which has an externally threaded and freely rotatable screw through the nut. On the end of each spindle is a jaw or gripping head for gripping a closure and removing the closure from the container by rotation of the screw and thus the gripping head. Axial displacement of the spindles with respect to the containers causes a gripping head to contact the closure on a container. Such axial displacement is accomplished by raising the containers in a case against the bottom end of each spindle having a gripping head thereon or by having a vertically movable nut platten with a screw therethrough which can be moved downwardly for contacting the closures on the containers by the gripping head on the bottom of each spindle. Axial displacement of the screw with respect to the nut, in a freely rotatable arrangement, rotates the screw with sufficient torque to break any temporary seal securing the closure to the container without the need of securing or holding the container against rotation. Thus, the method and apparatus facilitate the easy and quick removal of closures of containers in their cases by a low cost apparatus that can handle up to 40 cases per minute.

BRIEF DESCRIPTION OF THE DRAWINGS

FIG. 3 is a partial cross-sectional view of a spindle of the present invention showing the spindle in two stages of operation.

FIG. 4 is an end view of a head unit of the present invention.

Figure 1:
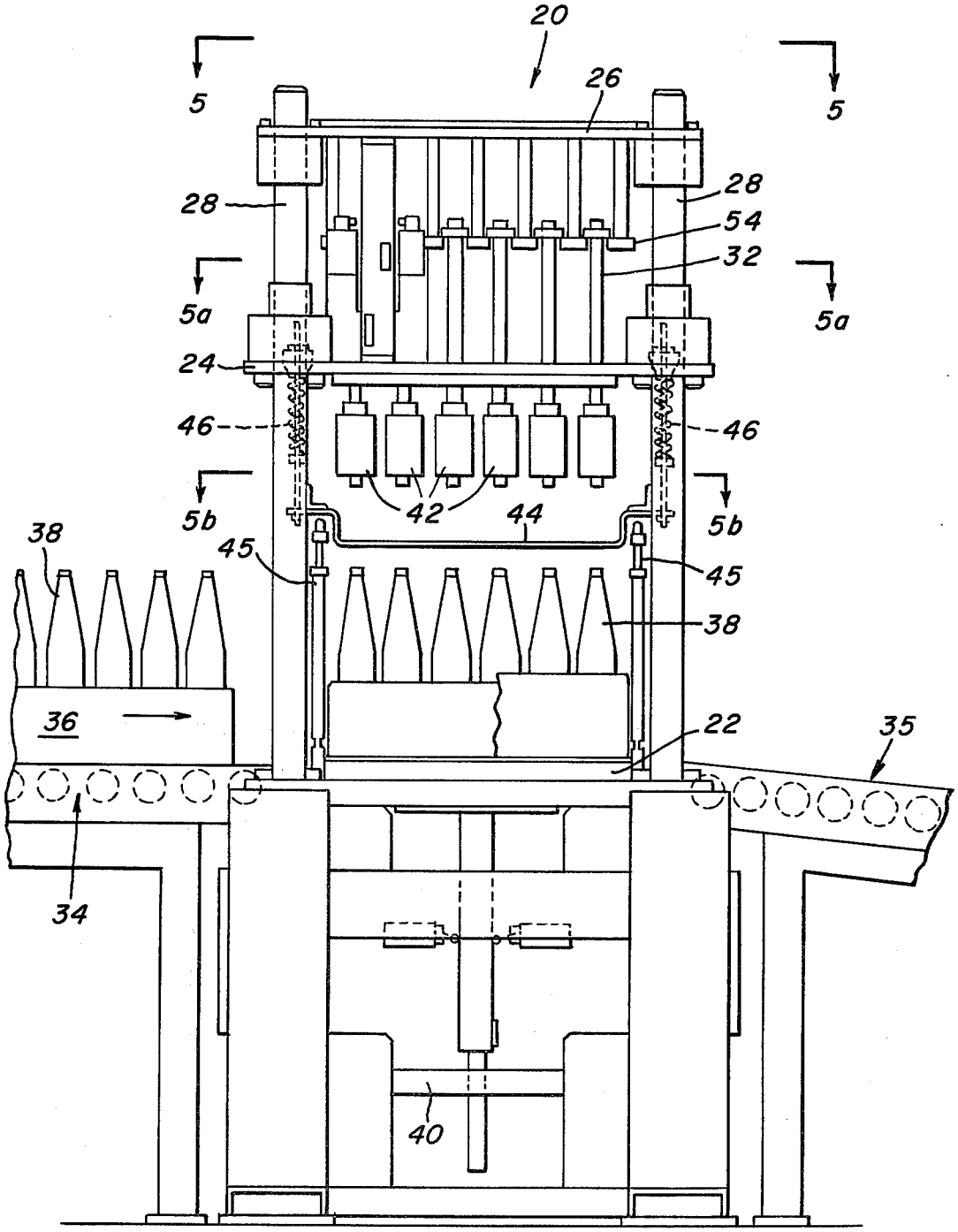
FIG. 1 is an elevation view of a preferred embodiment of the decapping apparatus of the present invention.

FIGS. **5–5*b* are top views of the decapping apparatus of FIG. 1** at several elevations.

FIGS. 6–11 are elevation views illustrating various stages of a preferred method of operation of the present invention.

DETAILED DESCRIPTION OF THE PREFERRED EMBODIMENTS OF THE INVENTION

FIG. 1 illustrates an elevation view of a preferred embodiment of the decapping apparatus 20 of the present invention. The apparatus 20 includes a case platten 22, a nut platten 24 and a spindle control platten 26 attached together by spindle control columns 28 and connector tie rods 30 (shown in FIG. 2). Nut platten 24 includes an array of multiple spindles 32 passing therethrough for gripping and removing closures from containers. A case 36 of containers or bottles 38 is moved into position in apparatus 20 by a conveyor 34 or the like. Spindle control columns 28 and connector tie rods 30 permit vertical displacement of the case platten 22, nut platten 24 and spindle control platten 26 with respect to one another and with respect to the spindles 32 for gripping and removing the twist-off closures of containers 38 in case 36. After removal of the closures, case 36 is removed from apparatus 20 by way of conveyor 35 or the like. The case may be assisted into and out of position in apparatus 20 by hydraulic piston action or the like.

Figure 2:
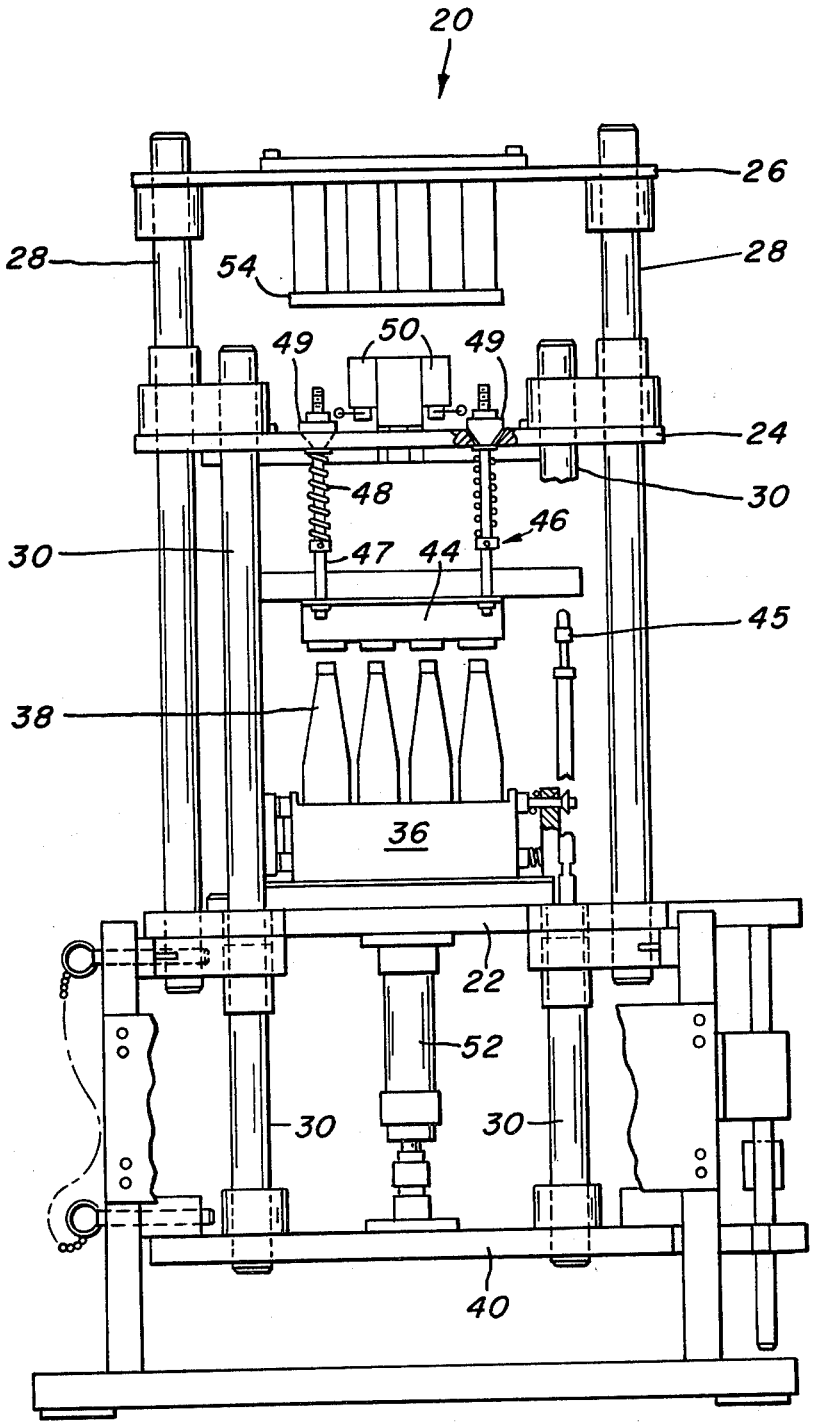
FIG. 2 is a side view in partial cross section of the apparatus of FIG. 1.

The spindle control columns 28 and connector tie rods 30 are arranged to permit vertical displacement of plattens 22, 24 and 26 with respect to one another during operation of the apparatus. In the preferred embodiment, FIG. 2 shows a side view of apparatus 20 having nut platten 24 attached to one end (the upper end) of connector tie rod 30 while the other end of tie rod 30 is attached to a base 40 of apparatus 20. Nut platten 24 is also slidably arranged on spindle control column 28 to permit relative movement therebetween. Case platten 22 is attached to one end of spindle control column 28 and is slidably arranged with respect to connector tie rod 30. Spindle control platten 26 is attached to the other end (the upper end) of spindle control column 28.

FIG. 1 further illustrates spindles 32 arranged in apparatus 20 such that the upper end of spindles 32 are attached to the spindle control platten 26, and are threadably engaged through nut platten 24 to terminate below nut platten 24 in a head unit 42 adapted for gripping and removing the closures from containers 38.

Bottle aligning and bottle stripping platten 44 is operably connected to nut platten 24 by a hanger device 46 as shown in FIG. 2. Bottle platten 44 is substantially a flat sheet having holes or openings 43 (not shown) therein which correspond to the array of bottles 38 in case 36 from which closures are to be removed. Preferably, bottle platten hanger 46 includes a rod 47 and a biasing element 48, such as a compression spring, that (in an uncompressed condition) will keep the bottle aligning and stripping platten 44 at its furthest extent below the nut platten 24. Rod 47, which connects with bottle platten 44 and extends vertically upward and substantially perpendicular thereto, is shown projecting above nut platten 24 with a collar means 49 on rod 47 to prevent the upper rod end from dropping below nut platten 24.

Limit switches 50 are provided to act as safety devices and may be activated when an upper portion of rod 47, such as collar means 49, of bottle platten 44 contacts them. Switch 50 can shut down apparatus 20 at the occurrence of a misalignment of the bottles in order to prevent damage to either bottles 38 or apparatus 20.

Platten stop rod 45 extends vertically upward and substantially perpendicular from case platten 22 to which it is attached. The upper portion of rod 45 extends to near and below bottle aligning platten 44. When there are no misaligned bottles during the relative movement of the case platten 22, nut platten 24 and spindle control platten 26, the upper part of rod 45 contacts bottle platten 44 and raises it so that the bottles do not contact bottle platten 44 and thus are not marred. Platten 44 thus provides a means for inspecting for misalignments.

In a preferred embodiment, apparatus 20 is also provided with a drive device 52, such as a piston, as a means for moving and vertically displacing case platten 22 with respect to nut platten 24 having spindles 32 thereon. One end of piston 52 is attached to base 40 and the other end is attached to case platten 22. Activating piston 52 raises case platten 22 and case 36 containing bottles 38 to cause removal of the closures on the bottles.

FIG. 3 illustrates a cross-sectional view of a preferred embodiment of spindle 32 of the present invention showing spindle 32 during two stages of operation. The center line of the spindle divides the figure to show the relative positions of the various symmetrical portions of the spindle during two conditions or stages of operation. The left-hand portion of FIG. 3 illustrates the spindle in a no-bottle or capless-bottle condition. The right-hand portion of FIG. 3 illustrates spindle 32 in what may be considered as a first stage condition of gripping a bottle closure.

FIG. 3 further illustrates spindle 32 arranged in position in nut platten 24 and attached to spindle hanger 54 of spindle control platten 26. Nut platten 24 includes a threaded nut or bush 56 through which an externally threaded screw 58 is disposed to permit axial travel of the screw with respect to the nut. Preferably, bush or nut 56 is of the ball-nut type such that it includes ball bearings 57 which engage with the threads of screw 58 to permit a freely rotatable arrangement of the screw in the nut. Bush or nut 56 may be an integral part of nut platten 24 or may be otherwise rigidly attached thereto by screws, bolts, welding or the like. Preferably, bush or nut 56 is rigidly attached to nut platten 24 by fasteners and is separated from the lower surface of platten 24 by a cushioning means, such as a rubber gasket. The cushioning means reduces the instantaneous impact load on the container when head unit 42 makes contact with the container.

Screw 58 is shown having a longitudinally and concentrically extending opening therein to permit a shaft or knock-out rod 60 to be slidably arranged therein. Rod 60 axially moves with respect to screw 58 during various stages of operation of spindle 32 depending upon whether or not a closure is located on bottle 38. Jaws or grippers 64 of head unit 42 are activated to grip a closure on bottle 38 by the action of a cam 62 located on or at the lower end of rod 60. Cam 62 may be integrally formed on the end of rod 60, but preferably cam 62 is separately formed and is attached to the lower end of rod 60. If no bottle, or if a capless bottle, is located beneath the spindle 32 during the decapping operation, then cam stem tip 66 of cam 62 will not contact a closure of a bottle or container 38 and will not cause the grippers or jaw 64 of head unit 42 to close around the top of the bottle. The left-hand portion of FIG. 3 shows such a condition. If a closure is present on container 38, the cam stem tip 66 will contact the top of the closure causing knock-out rod 60 to slide upwardly within screw 58 and activate jaws 64 by the interaction with cam 62, as shown in the right-hand portion of FIG. 3.

The upper end of spindle 32 is arranged within a spindle hanger 54 and is maintained therein by spindle retractor 68 at a no-bottle location during the operation of spindle 32 when spindle retractor 68 contacts spindle hanger 54 to limit the vertical downward movement of head unit 42 of spindle 32. Contact of retractor 68 with hanger 54 prevents further relative movement of head unit 42 toward case platten 22 for the remainder of a single cycle of the decapping operation. Spindle retractor 68 which forms the upper end of spindle 32 has slidably arranged therein the upper end of knock-out rod 60 which terminates in a knock-out cap 70. Rod 60 is concentrically and slidably located within spindle retractor 68 with the downward movement of rod 60 at a no-bottle or no-cap condition limited by the contact of cap 70 with spindle retractor 68 within spindle hanger 54. Knock-out rod 60 is designed with knock-out cap 70 at its upper end for contact with a portion of spindle control platten 26 designated as knock-out knob 72 within spindle hanger 54 to cause ejection of a closure from grippers 64 of head unit 42 at the termination of a single cycle of the decapping operation.

Spindle 32 further includes a braking means or spindle latching assembly 74 for locking and holding the spindle during certain conditions to prevent rotation of screw 58 in nut 56. Latch 74 is particularly useful to hold the spindle in a retracted position during liftaway of the unscrewed closure from the bottle 38 during the decapping operation. As used here "retracted" means that condition when screw 58 has been caused to rotate within nut 56 such that it is at its farthest vertical upward axial travel with respect to nut 56. As illustrated, spindle latch assembly 74 can include balls or bearings 76 and a spindle latching groove 78 which cooperate to prevent screw 58 from freely rotating within ball nut 56 to cause further vertical downward axial travel of screw 58 within nut 56.

FIG. 4 illustrates an end view of head unit 42 as seen by a bottle closure. While FIG. 3 illustrated only two jaws 64 in head unit 42, FIG. 4 shows the preferred embodiment having three jaws 64 equally spaced about the axis of head unit 42 near cam stem tip 66.

Figure 5:
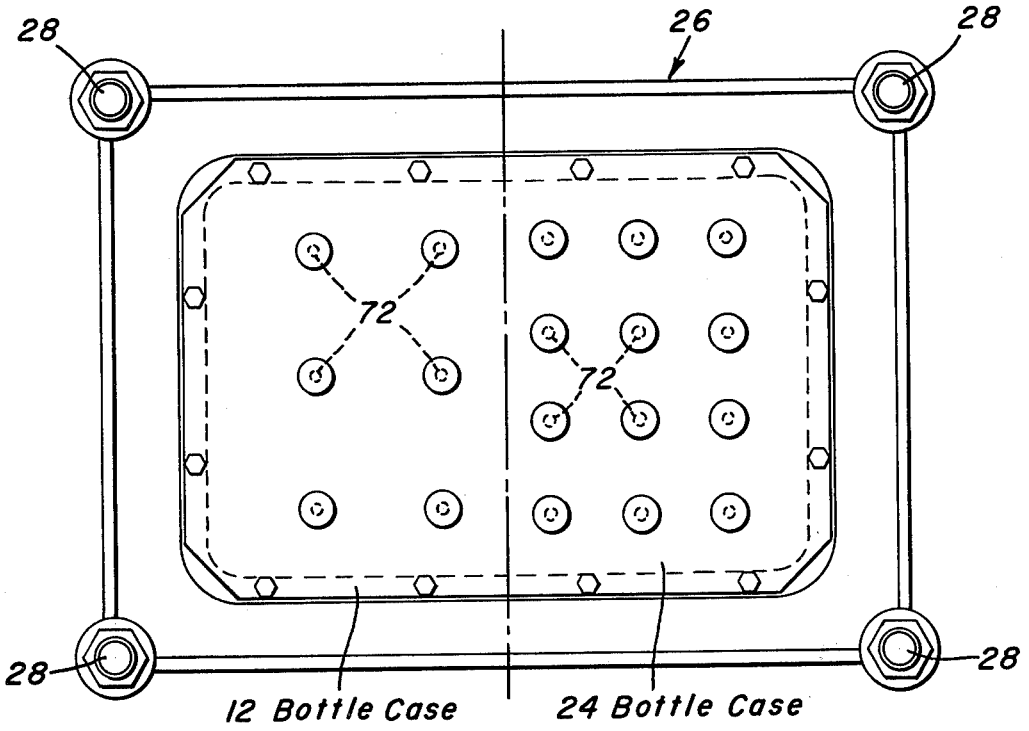
Figure 5A:
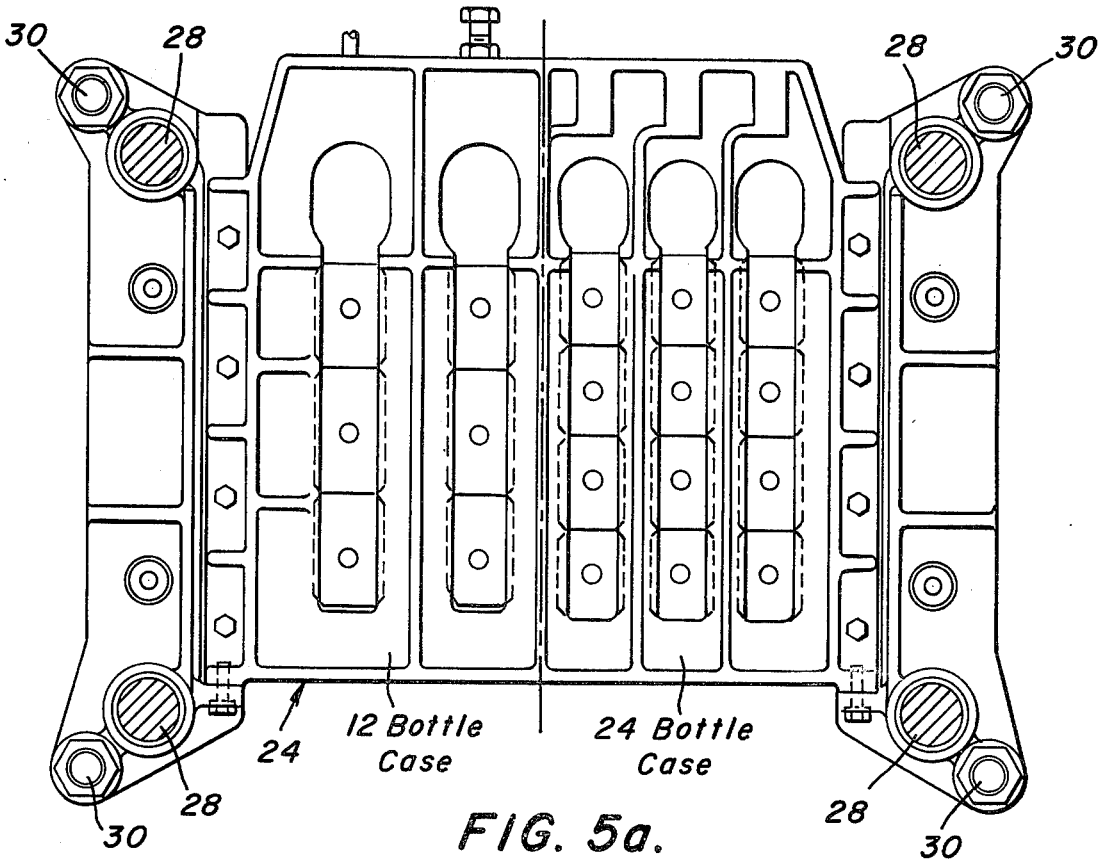
Figure 5B:
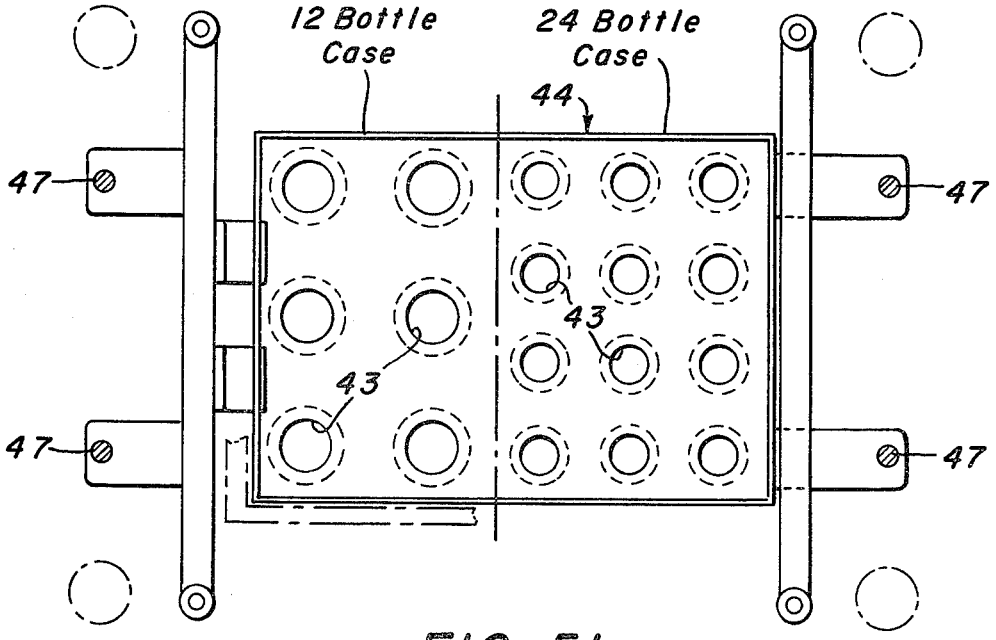

FIGS. 5, 5*a* and 5*b* are top views of spindle control platten 26, nut platten 24 and bottle aligning and stripping platten 44, respectively, of decapping apparatus 20. FIG. 5 illustrates platten 26 rigidly and, preferably, detachably secured to spindle control columns 28 of apparatus 20 at peripheral locations. Also shown, for illustrative purposes, on either side of the centerline are two arrays of spindle locations corresponding to container-receiving positions as they may be for two different cases of bottles. The left side of the centerline is an array corresponding to a twelve (12) bottle case, while the right-side array is for a twenty-four (24) bottle case.

The array shows positions of knock-out knobs 72 which project from the undersurface of platten 26. For changing over apparatus 20 to handle cases of containers of different size and array, spindle control platten 26 may be removable from columns 28 so that another platen 26 providing a different array can be secured.

For FIGS. 5, 5*a* and 5*b* the two arrays are shown merely for illustration, for usually an entire case of containers consists of the same size containers and thus only a single array of container-receiving positions. Decapping apparatus 20 may be adaptable to handling cases of containers of varying sizes and thus different arrays if such arrays are uniform and not randomly varied in successive cases.

Nut platten 24 shown in FIG. 5*a* includes an array of bush or nut 56 locations corresponding to the container-receiving positions of a case. For illustration, the centerline divides the figure so as to show that different arrays can be used. Platten 24 is provided with means to permit lateral adjustments of nuts 56 therein and therefore corresponding lateral adjustments of multiple spindles 32 for decapping apparatus 20. Preferably, platten 24 provides for changeable nuts 56 which can be positioned and locked to form the desired array. Alternately, the entire nut platten 24 may be removable from apparatus 20 and replaced with another platten having a different array.

FIG. 5*a* also illustrates an alternative arrangement for securing platten 24 to spindle control column 28 and connector tie rod 30. Column 28 is shown slidably arranged in platten 24 and inwardly of the securing location for tie rod 30. FIGS. 1 and 2 show column 28 slidably arranged outwardly of connector tie rod 30.

In FIG. 5*b*, bottle aligning and stripping platten 44 is illustrated with the centerline dividing the figure to show different arrays of openings 43. Preferably, platten 44 can be removed and replaced with a platten having the desired array.

In the operation of the apparatus of the present invention, the multiple spindles are axially displaced with respect to the containers to cause the head unit of each spindle to grip a container by its closure; axial displacement of the screw with respect to the nut causes rotation of the screw with sufficient torque to break any bond or seal securing the closure. A closure can be removed without the need of securing or holding the container against rotation for a concurrent momentary axial load is applied to the container and prevents container rotation due to the resultant friction between the container bottom and the container case. FIGS. 6 through 11 illustrate a preferred method of operation of the present invention which is designated the "case-lift" method. In the case-lift method, nut platten 24 remains stationary and the case platten 22 and spindle control platten 26 interconnected by spindle control column 28 cause axial displacement of container 38 with respect to head unit 42 of spindle unit 32. In the case-lift method, a case of containers 38 are vertically displaced such that the closures on the containers contact jaws or grippers 64 of head unit 42. Further vertical displacement of the containers causes screw 58 of spindle 32 to rotate within nut platten 24 to cause removal of the closures from the containers.

FIG. 6 illustrates two stages of operation. The left side of the centerline of FIG. 6 shows spindle 32 in an upward locked arrangement above container 38. As shown in the ready condition on the right side of the centerline of FIG. 6 in partial cross section, spindle 32 is in a down unlocked arrangement. The bottle aligning and stripping platten 44 is in position between the head unit 42 and the top of container 38. The bottle platten hanger 46 is shown with its biasing element, spring, 48 in an uncompressed state, thus having platten 44 disposed downwardly at its furthest extent. The upper end of spindle 32 is shown by the knock-out cap 70 of knock-out rod 60 and by the spindle retractor 68 at approximately a midway point in spindle hanger 54. Note that the jaws or grippers 64 of head unit 42 are in an open position with cam stem tip 66 protruding downward from head unit 42. While the left side of FIG. 6 shows spindle latch 74 in locked engagement to prevent screw 58 from freely rotating in nut 56 of nut platten 24 and resulting in vertically downward axial displacement, the right side of the centerline shows spindle 32 in a free down position with spindle latch 74 unlocked from screw 58.

FIG. 7 is in partial cross section to illustrate case-lift platten 22 and spindle control platten 26 in an upward vertically displaced position such that the closure of bottle 38 has contacted head unit 42 causing the cam stem tip 66 to enter the head unit and activate the grippers or jaws 64 to grip the closure on the container. The top end of container 38 has passed through an opening 43 in the bottle aligning and stripper platten 44. Note that if there was no container in position below spindle 32 when case platten 22 was displaced, the cam stem tip 66 would not have activated the grippers 64 of head unit 42. If no closure was on the container, the cam stem tip 66 would have entered the open mouth of the container and also not activated grippers 64. In the position illustrated in FIG. 7, bottle platten stop rod 45 has just made contact with bottle aligning and stripper platten 44. Any further upward movement by case platten 22 will cause the bottle stripper platten 44 to move upwardly in unison with case platten 22 and spindle control platten 26. Preferably, stripper platten 44 does not contact the top outside surfaces of container 38 which has passed through opening 43, thus avoiding any contact which can wear and mar the container.

The upper end of spindle unit 32 has been displaced within the spindle hanger 54 of spindle control platten 26. While spindle 32 has remained stationary in nut platten 24, the unitary movement of case platten 22 and spindle control column 28 has caused a vertical upward displacement of spindle control platten 26. Note that the spindle retractor 68 has not made contact with the lower part of spindle hanger 54 when a closure is present on container 38. If, however, no container is in position to meet spindle 32, the spindle retractor 68 will contact spindle hanger 54 to limit further downward vertical displacement of head unit 42 with respect to a container location. When no container is in position, hanger 54 also lifts spindle 32 upward by retractor 68 as case platten wall 22 and thus spindle control platten 26 continue vertical upward displacement to remove closure on other containers. Note also that, as shown in FIG. 7 with a container in position, knock-out cap 70 is displaced above spindle retractor 68 in the spindle hanger 54. Such a displacement is due to cam stem tip 66 contacting a container closure and causing the knock-out rod 60 to be axially moved within screw 58 of spindle unit 32.

If no cap or closure is present on a container then cam stem 66 would enter the open mouth of the container. The container end would be likely to contact the underface of head unit 42. Continued upward movement of case platten 22 would press the mouth of a no-cap container against the face of head unit 42. Though not shown, that portion of the face of head unit 42 should be freely rotatable and independent of the rotation of screw 58. As closures of other containers in a case are being unscrewed, any rotational action that screw 58 would have on a no-cap container, in the absence of an independent face of head 42, is eliminated. Thus, a no-cap container will not rotate while caps on other containers are being removed. Though it is probably desirable that contact between the face of head unit 42 and a no-cap container be avoided, the relatively small thickness dimensions of a closure and the actual variations and tolerances in container heights most likely results in some contact. Additionally, to eliminate and minimize any damage to the mouth of the container, the underface of head unit 42 can be provided with a cushioning material. For example, a resilient material O-ring can surround cam stem tip 66 near the lower part of cam 62 for contact with the mouth of the no-cap container.

If a container was misaligned such that the container top end failed to pass through an opening in bottle aligning platten 44, then the top end of the container would be contacting the lower surface of platten 44, as case platten 22 is upwardly displaced. Such continued upward vertical displacement results in the container forcing the bottle aligning platten 44 upwards until collar means 49 of hanger rod 47 contacts and activates limit switch 50. Actuation of switch 50 stops further displacement by shutting down apparatus 20 and returning case platten 22 downwardly to its lowest position.

Figure 8:
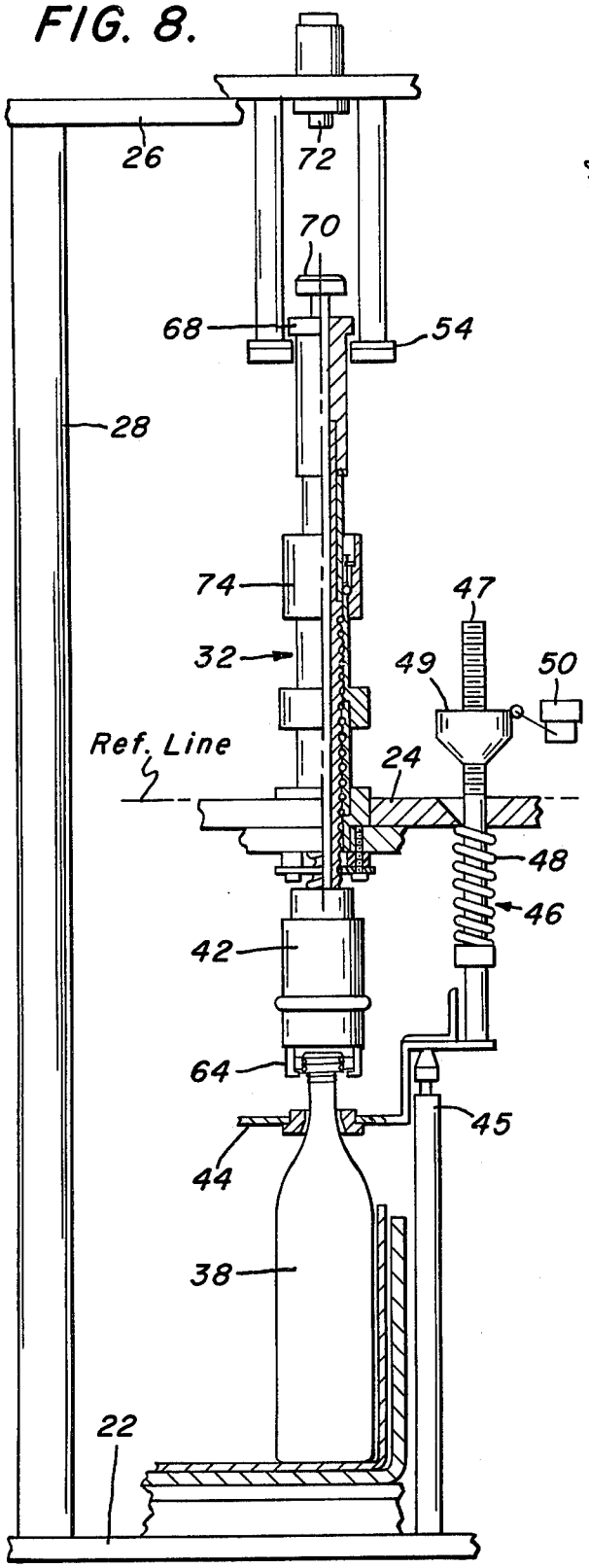

FIG. 8 is in partial cross section and illustrates a case platten 22 at the top of its stroke; container 38 has its closure unscrewed but still held by the jaws of head unit 42. Normally, the entire vertical stroke of case platten 22 may approximate a distance of five inches. The vertical displacement of case platten 22 during only the unscrewing operation, i.e. during the time period between FIGS. 7 and 8, may approximate two inches. In the position illustrated, biasing element 48 of bottle platten hanger 46 is in a compressed condition. The compressed condition is maintained by the action of bottle platten stop rod 45 pushing upwardly against the aligning and stripping platten 44. Note that platten 44 is not in contact with the neck of container 38. Spindle latch 74 is in a locked condition to prevent screw 58 from freely rotating in bushing or nut 56 and rescrewing the closure onto container 38. If screw 58 were to freely rotate downwardly, the effectiveness of releasing the closure by the contact of knock-out cap 70 with knock-out knob 72 may be reduced. Also reduced would be the clearance for discharging closure between the removed closure gripped by head unit 42 and the mouth of a container which has been lowered away. During the period of operation between FIGS. 7 and 8, ball 76 and groove 78 of latch 74, being disengaged, allow the screw 58 to be rotated in nut 56 by the action of container 38 contacting and pressing against head unit 42. A momentary axial load on the container creates friction between the container bottom and the case so that the closure can be unscrewed without the need to secure the container. The knock-out cap 70 is still displaced from and above spindle retractor 68 due to the jaw closing cam 62 displacement and the closure is held by the jaw means of head 42. Spindle retractor 68 in the upper end of spindle 32 is adjacent but not contacting the lower end of spindle hanger 54.

As shown in FIG. 8, when case platten 22 has reached the top of its stroke, collar means 49 of hanger rod 47 makes contact with limit switch 50 as a result of bottle platten stop rod 45 pushing upwardly and displacing bottle aligning platten 44. Distinct from the shutdown maneuver in the occurrence of a bottle misalignment, switch 50 can be made electrically inoperative so as not to stop further action. In the alternative, an arrangement may be provided which avoids any contact with switch 50 when containers are properly aligned for decapping.

Figure 9:
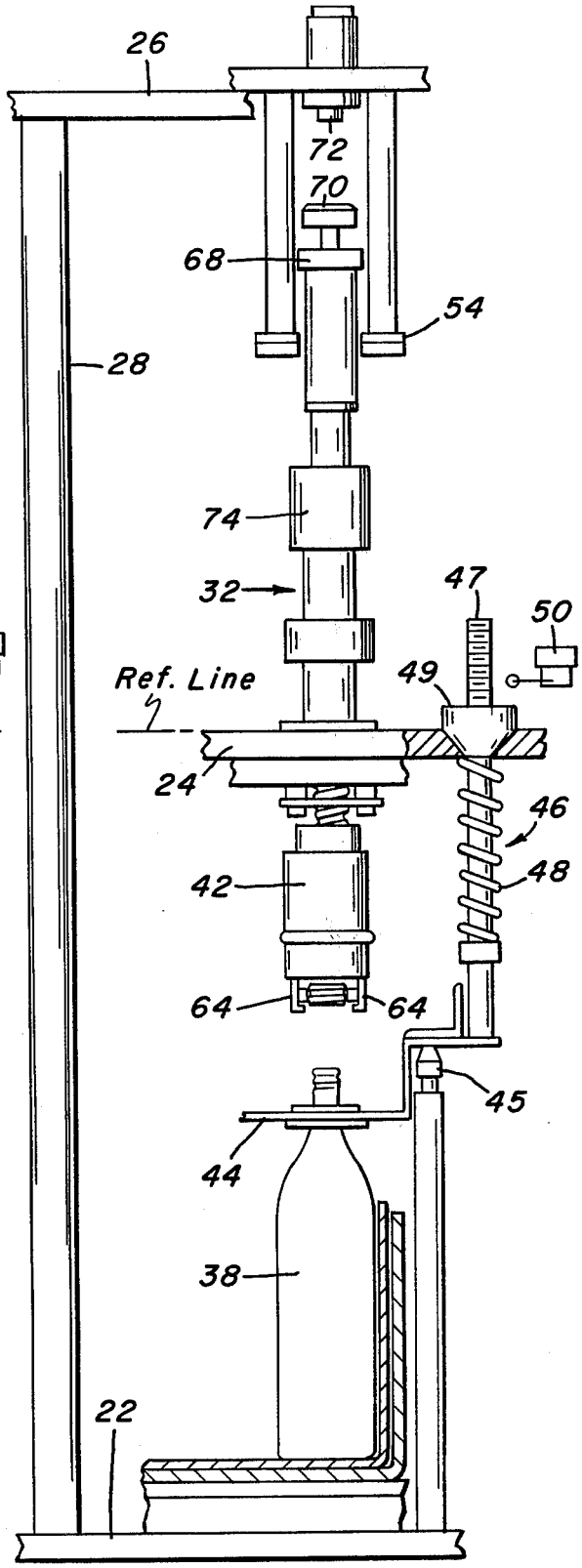

FIG. 9 illustrates spindle 32 locked in position within nut platten 24 by spindle latch 74 with the removed closure in the jaws 64 of head unit 42. The downward movement of case platten 22 and spindle control platten 26 with spindle control column 28 causes the upper end of spindle 32 at knock-out cap 70 and spindle retractor 68 to move to approximately a midway position within spindle hanger 54 of spindle control platten 26. When case platten 22 continues to move downwardly, knock-out knob 72 of spindle control platten 26 will approach knock-out cap 70 of spindle control platten 26.

FIG. 9 further illustrates bottle platten stop rod just prior to breaking contact from bottle aligning and stripper platten 44. At such a breakaway point, the biasing element spring 48 of bottle platten hanger 46 has just reached its uncompressed condition, i.e. bottle platten hanger 46 is at its furthest extent downward. In the normal operation of the decapping apparatus 20, container 38 will be displaced downwardly as case platten 22 moves downwardly. In certain circumstances, the container may remain temporarily secured to the untwisted or unscrewed closure. In such conditions, and only then, will the opening periphery of stripper platten 44 make contact with container 38 forcing it downward and away from the untwisted closure held in grippers 64 of head unit 42. Such a downward force will cause the container to drop into its proper location in the case of containers. The downward force of stripper platten 44 is assisted by the biasing element 48 before it reaches its uncompressed state.

Figure 10:
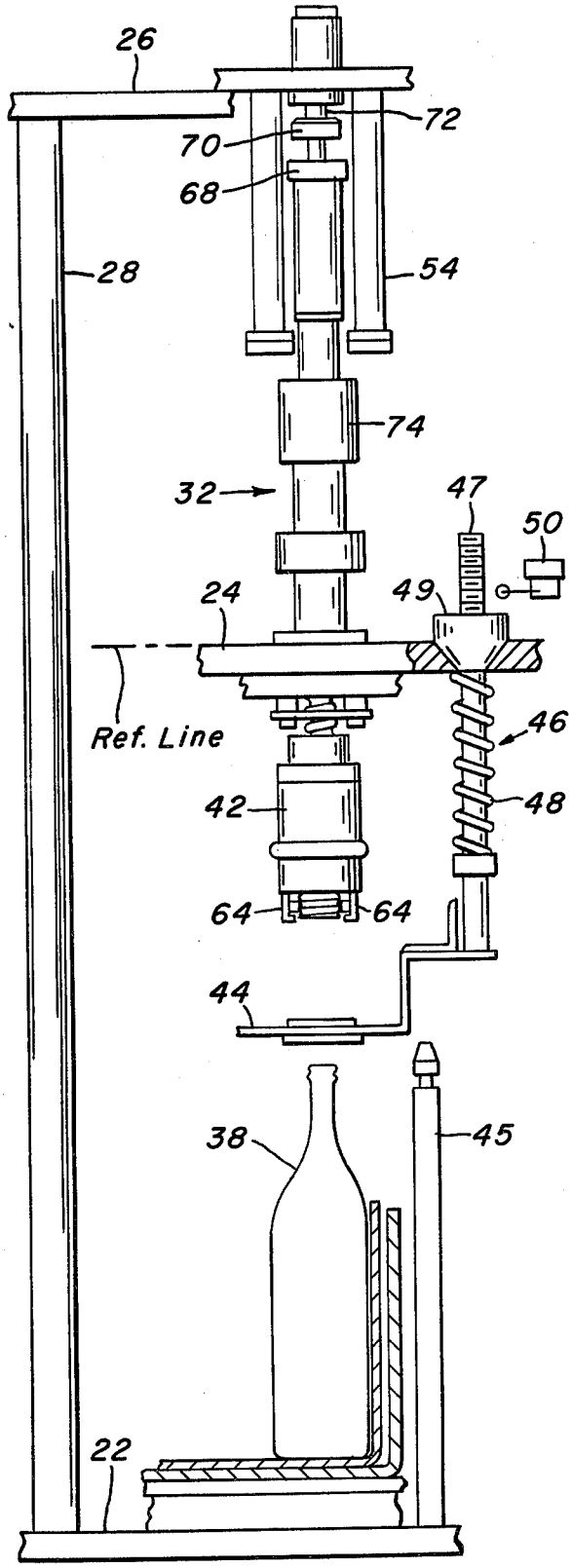

FIG. 10 illustrates continued downward movement of case platten 22 at a point where the upper end of spindle 32 at knock-out cap 70 is just making contact with knock-out knob 72 of spindle control platten 26. Spindle latch 74 is approaching the bottom portion of spindle hanger 54, but latch 74 is still locked to prevent free rotation of screw 58 in nut 56. Case platten 22 is moved sufficiently downward such that bottle platten stop rod 45 no longer is contacting bottle aligning and stripper platten 44 and container 38 has fallen into its proper location in case 36. The unscrewed closure is just about ready to be removed from jaws 64 of head unit 42.

Figure 11:
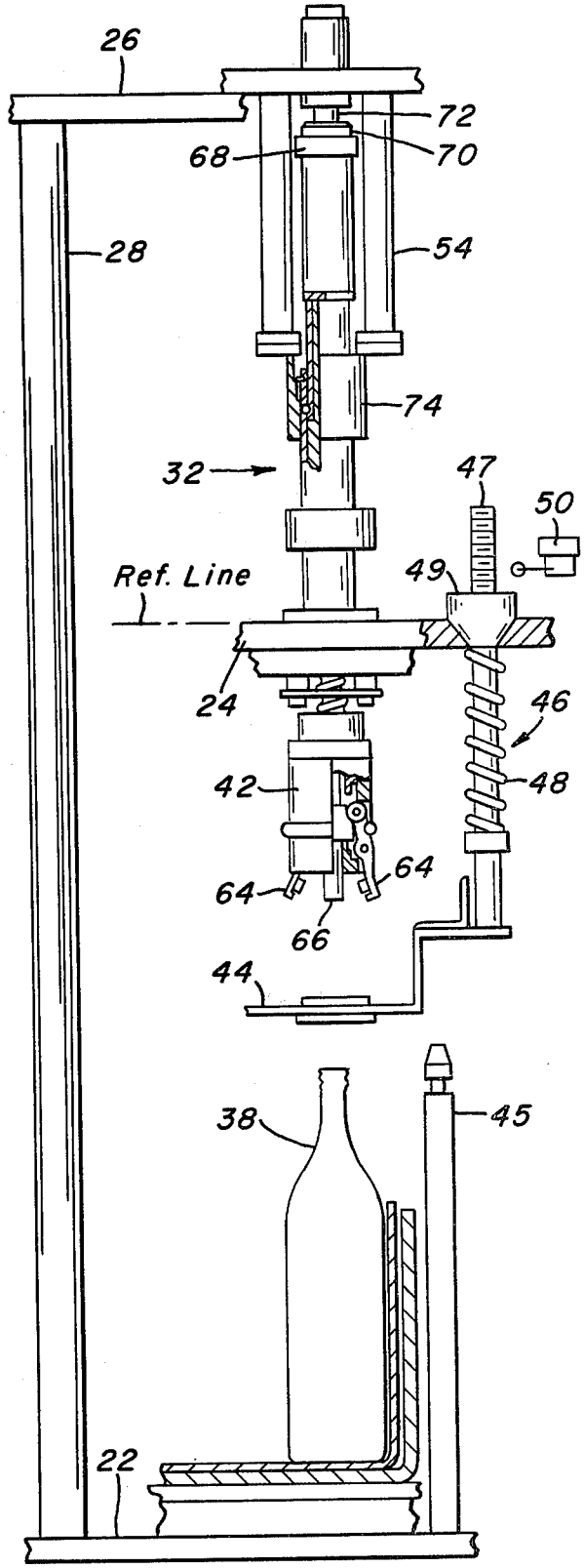

FIG. 11 illustrates spindle 32 just after the knock-out phase of operation, i.e. the removal of the closure from gripper 64 of head unit 42 just as or prior to case platten 22 reaching the bottom of its downward traverse to its original starting position. The continued downward movement of case platten 22 and spindle control platten 26 results in knock-out knob 72 of spindle control platten 26 exerting a pressure on knock-out cap 70 of knock-out rod 60. Such pressure on knock-out cap 70 forces the rod 60 to move axially within the screw 58 of spindle 32 resulting in cam stem tip 66 ejecting the closure out of jaws 64 and at substantially the same time knock-out cam 62 opening the grippers and releasing the closure from head unit 42. Release and ejection of the closure may be assisted by an air blast or other means to speed up and direct the unscrewed closures away from jaws 64 to a collection chamber, for example.

Spindle latch 74 contacts the bottom portion of spindle hanger 54. Such contact will prepare the spindle latch 74 to unlock the screw 58 during the last stages of the downward traverse of case platten 22. When case platten 22 reaches its downward limit, the spindle latch 74 will unlock screw 58 in nut 56 and allow screw 58 to freely rotate in nut 56 to its downward extension at the bottom of its traversing stroke. It will then be at the same position as shown in FIG. 6 (right side) so that the decapping operation is ready to commence on another case of containers.

A knock-out spring may be provided with knock-out knob 72 such that after the closure is released and knock-out cap 70 is still in contact with knob 72, a spring will be compressed or loaded. The spring-loaded contact can be discharged to force and assist return of spindle 32 downwardly when spindle latch 74 unlocks.

As described above, the preferred method of operation of the present invention is using the case-lift method. In an alternative method of operation, the case platten 22 and the spindle control platten 26 remain stationary while the nut platten is moved vertically to provide relative displacement of the containers with respect to head unit 42. The mode of operation is basically the same as that described in the case-lift method with the relative movement between elements of the spindle and the container being the same. The main difference is that nut platten 24 and not case platten 22 is vertically displaced.

Having thus described the invention, what is claimed is:

1. Apparatus for removing screw-off closures from containers assembled in cases, which comprises:

(a) a spindle platten including multiple spindles arranged with respect to container positions in a case, with each spindle aligned with each container-receiving position in the case;

(b) a nut platten including non-rotatable internally threaded low friction nuts, one of said nuts associated with each spindle;

(c) an externally threaded hollow screw on each spindle disposed through said nut, said screw being freely rotatable in said nut and adapted to turn in said nut in response to axial travel of said screw with respect to said nut;

(d) jaw means on the bottom end of each spindle for gripping a closure on a container to remove the closure from the container by rotation of the jaw means with said screw;

(e) separate means for supporting the case and jaw means to provide relative movement between the case and the jaw means;

(f) a shaft slidably arranged within said hollow screw of each spindle with the lower end thereof extending below the bottom end of said spindle and through said jaw means for contacting the top wall of a closure on a container to activate said jaw means to grip a closure on a container as said shaft is pushed upwardly due to said relative movement through said screw by the top wall of the closure;

(g) means on said spindle platten for contacting the upper end of said shaft after removal of the closure from the container to push said shaft downwardly through said screw to release the grip of said jaw means and eject a closure held thereby:

(h) means for non-rotatably moving said screws and said nuts associated with each spindle axially with respect to the case of containers to move said jaw means toward the containers and into position to automatically grip closures on the containers, thereafter axially displacing said screw with respect to said nut by a relative pushing of said screw upwardly and rotatably through said nut by the container and closure thereon to rotate said screw and jaw means thereon with respect to the containers to unscrew closures from the containers, thereafter non-rotatably moving said screws and said nut axially with respect to the containers to move said jaw means and unscrewed closures away from the containers, and thereafter releasing the grip of said jaw means and ejecting the closure therefrom.

2. An apparatus as set forth in claim 1 wherein said means for moving said spindles axially comprises a case platten movable in unison with said spindle platten, said case platten for raising containers in a case against said jaw means on the bottom end of each spindle for gripping closures on the containers by said jaw means, and thereafter, further raising the containers to push said screws on said spindles upwardly and rotatably through said associated nuts of said nut platten to unscrew the closures.

3. An apparatus as set forth in claim 1 wherein said nut platten is movable for non-rotatably lowering said spindles and said jaw means on the bottom end of each spindle against containers in a stationary case for said jaw means to grip closures on the containers, and thereafter further lowering of said nut platten to push said screws in each spindle upwardly and rotatably through said associated nuts of said nut platten to unscrew the closures.

4. An apparatus as set forth in claim 1 further comprising brake means to prevent free rotation of said screw axially downwardly through said non-rotatable nut after said screw has been pushed and rotated upwardly through said nut to unscrew a closure from a container.

5. An apparatus as set forth in claim 1 further having a means for inspecting each of the containers for proper positioning thereof before contact by said jaw means on said spindles, said means including a substantially flat member having openings therein corresponding to an array of containers in a case for noncontactingly receiving a properly aligned container in each opening, and including a shut-off means to prevent contact of the containers by said jaw means that could damage said apparatus and containers in the event of misalignment of a container, said shut-off means being responsive to contact of a misaligned container with said flat member of said inspecting means.

6. An apparatus as set forth in claim 1 further comprising a means for adjusting the lateral spacing between said multiple spindles, said means having a platten of changeable nuts which can be fixed in an array corresponding to an array of containers to accommodate cases of different sizes and different arrangements of container positions.

7. An apparatus as set forth in claim 1 further comprising means for moving cases of containers seriatum into and out of position below said multiple spindles.

8. A method of removing screw-off closures from containers assembled in cases, which comprises:

(a) guiding cases of containers seriatum into and out of a temporary stop at a location disposed below multiple spindles, with each spindle aligned with each container-receiving position in a case;

(b) non-rotatably translating said spindles axially with respect to the containers in a case until grippers on the bottom end of said spindles contact screw-off closures on the containers;

(c) mechanically detecting the presence of a closure on a container for said gripper on each spindle to grip a closure on a container by contacting the lower end of a shaft slidably arranged within a hollow screw of each spindle and extending through said gripper with the top wall of a closure on the container; and thereafter (d) automatically grasping closures on the containers with said grippers of said spindles as said shaft is pushed upwardly through said screw by the top wall of the closure, while (e) applying a downward force of said spindles against the closures to push said shaft upwardly through said screw by the top wall of the closure to activate said grippers to grasp closures on containers and to press the containers against the case to prevent rotation of the containers;

(f) further applying the downward force against the closures to axially displace said screw of each spindle upwardly by the top wall of the closure through a non-rotatable associated threaded nut, through which the screw is freely rotatable, to rotate said screw and grippers thereon in said nut with torque sufficient to break any temporary seal securing the closures to the containers to unscrew the closures from the containers;

(g) non-rotatably translating said spindles axially with respect to the containers to move said grippers and unscrewed closures away from the containers; then (h) releasing the grasp of said gripper and ejecting the removed closures from said grippers by forcing the upper end of said shaft downwardly to push said shaft downwardly through said hollow screw.

9. A method as set forth in claim 8 wherein the steps of non-rotatably translating said spindles with respect to the containers and applying a downward force of said spindles against the closures include raising a case of containers to contact with and to push against the bottom end of said spindles.

10. A method as set forth in claim 8 wherein the steps of non-rotatably translating said spindles with respect to the containers and applying a downward force of said spindles against the closures include lowering said spindles by said associated nuts for the bottom end of said spindles to contact with and push against the containers.

11. A method as set forth in claim 8 further comprising locking said screws in the associated nuts to prevent free rotation of said screws axially downwardly through said nuts after unscrewing closures from containers, and thereafter unlocking said screws in said nuts to allow said screw to freely rotate axially downwardly after ejection of the closures from the grippers.

12. A method as set forth in claim 8 further comprising inspecting the cases of containers by a bottle aligning platten having openings corresponding to an array of containers before contact of the containers by said grippers on said spindles and stopping the axial travel of said spindles with respect to the containers in the event of misalignment of a container.

* * * * *